United States Patent [19]

McCall

[11] 4,129,247

[45] Dec. 12, 1978

[54] DIE-CUT CARTON WITH BUILT-IN FILLERS

[76] Inventor: Richard J. McCall, 1515 N. Sedgwick St., Chicago, Ill. 60610

[21] Appl. No.: 838,245

[22] Filed: Sep. 30, 1977

[51] Int. Cl.[2] ..... B65D 5/22; B65D 5/24

[52] U.S. Cl. ..... 229/36; 229/34 R

[58] Field of Search ..... 229/DIG. 1, 14 C, 34 HW, 229/34 R, 36

[56] References Cited

U.S. PATENT DOCUMENTS

| | | | |
|---|---|---|---|
| 1,207,899 | 12/1916 | Greue | 229/14 C UX |
| 2,295,141 | 9/1942 | Van Wingen | 229/34 R |
| 3,003,676 | 10/1961 | De Nola | 229/34 HW |
| 3,883,067 | 5/1975 | McGlynn et al. | 229/34 R |
| 3,973,723 | 8/1976 | Owens | 229/36 X |

*Primary Examiner*—Davis T. Moorhead

*Attorney, Agent, or Firm*—Hill, Gross, Simpson, Van Santen, Steadman, Chiara & Simpson

[57] ABSTRACT

A sheet of corrugated material is die-cut and -scored into a one-piece blank formable into a closed carton having integral corner fillers which are formed and strategically located automatically upon erection of the walls of the box. The integral fillers are double-thickness corrugated material and cooperate with quadruple-thickness end walls to protect corners and end and side edges of carton contents such as books during mailing and handling.

1 Claim, 9 Drawing Figures

DIE-CUT CARTON WITH BUILT-IN FILLERS

BACKGROUND OF THE INVENTION

1. Field of the Invention

The present invention relates to one-piece foldable boxes or cartons adapted for mailing heavy items such as books.

2. The Prior Art

Regular slotted cartons have long been used in the corrugated carton industry, wherein separate layers of filler materials are adapted to be inserted at each end of the carton after filling with books or other contents. With such separate fillers, it is necessary to stockpile the fillers as well as the carton blanks. Where supplies do not match or where fillers are otherwise omitted, the cartons may be mailed without fillers, thereby jeopardizing the contents of the box.

SUMMARY OF THE INVENTION

A corrugated, sheet-form blank is die-cut and -scored for erection into a closed rectangular carton. Double end walls capture a locking flap of the side walls therebetween and also carry extra flaps which extend inwardly of the carton along the side walls automatically to form filler layers and to strategically locate such fillers at the corners of the erected carton. The fillers preferably each comprise a double-thickness of material folded back on itself from a side edge of the inner one of the end walls. A pair of locking flaps each attached to an outer part of the filler material extend between the side wall locking flaps and the inner wall to lock the filler assembly into position in cooperation with locking tabs on the inner end walls and tab receptacles in the bottom panel of the carton.

THE DRAWINGS

THE PREFERRED EMBODIMENTS

Figure 1:
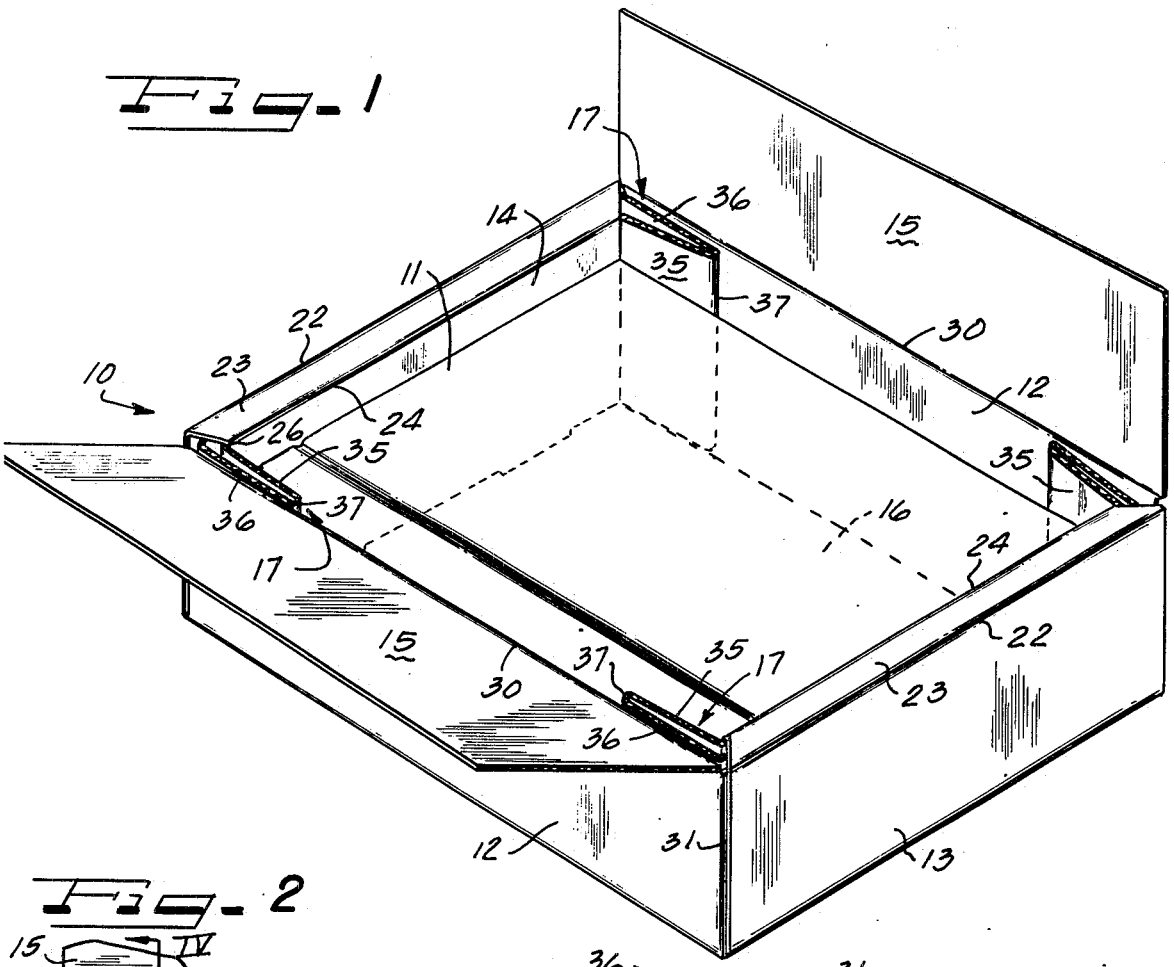
FIG. 1 is a general perspective view of a carton of the present invention, partially filled with books.

A carton 10 constructed in accordance with the invention is shown in FIG. 1 filled with book(s) 11 or other contents. The carton 10 comprises side walls 12, outer end walls 13 and inner end walls 14, top panels 15, and a bottom panel 16. All of the panels and flaps 12, 13, 14, and 15 are substantially rectangular in form and are joined directly or indirectly to one another by edge fold lines, as shown in the full development view of FIG. 5.

Figure 5:
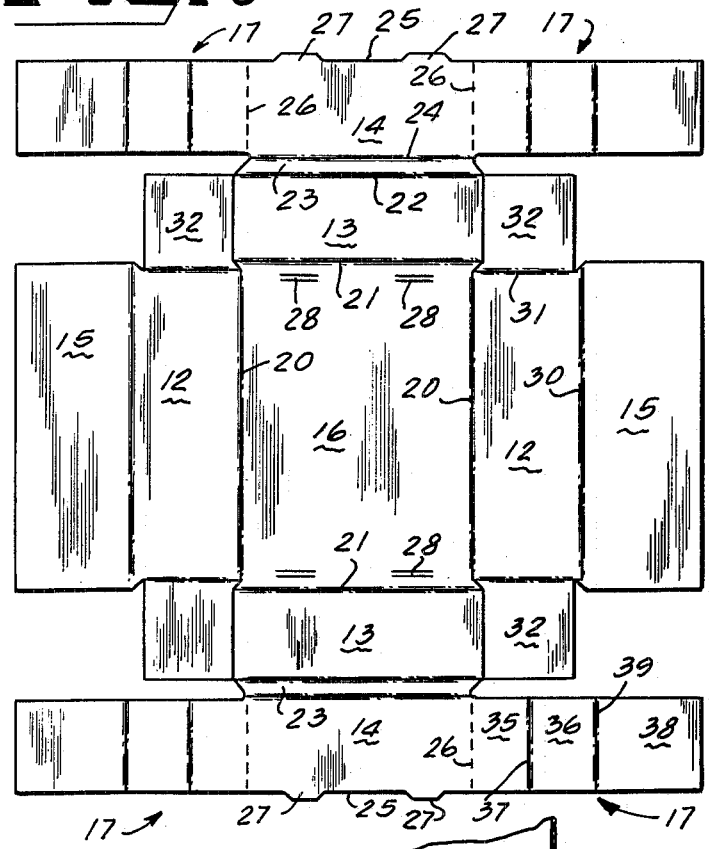
FIG. 5 is a top plan view of the fully developed sheet-form blank of the present invention.

In accordance with the invention, integral corner filler flaps 17 are provided at each inside corner of the carton 10. As shown in FIG. 5, the bottom panel 16 has pairs of opposite side edges 20 and end edges 21 connecting respectively to the side wall panels 12 and outer end wall panels 13. Each of the outer end wall panels 13 has a top edge fold line 22 connecting to a cover member or plate 23 and, by a further top edge fold line 24, to the inner end wall panel 14. The inner end wall panel 14 has a free bottom edge 25 and a pair of opposite side edges 26. Formed integrally with the inner end wall panel 14 is a pair of locking tabs 27 extending beyond the bottom edge 25. The tabs 27 engage a pair of tab receptacles 28 formed in the bottom panel 16 by two parallel cut lines separated by a distance equal to one thickness of the corrugated material of the carton 10 and spaced from the end edge 21 by about three thicknesses of such material.

The side walls 12 are connected to the blank 16 at the side edge fold lines 20. Each side wall 12 has a top edge 30 which foldably connects to the top flap 15. For economy of materials in construction and for economy of storage space for the blanks, the top flaps 15 are preferably formed in two parts as shown, although a single covering flap or other variation could also be employed. The side walls 12 also each have opposite end edges 31 which connect to side wall end locking flaps 32.

As shown in FIG. 5, various of the fold lines and side and end edges are offset from one another to accommodate the thickness of the corrugated material of the sheet-form blank, as is known to those skilled in the art. For instance, the outer end walls 13 are wider by at least two thickness of material than the bottom panel 16, and the end edge 21 of the bottom panel 16 is set about one thickness of material beyond the end edge fold line of the side walls 12. Then the side wall end locking flaps 32 fit to the inside of the outer end walls 13 and the side edges of the outer end wall 13 cover the end edge 31 of the side walls 12.

In accordance with the invention, the corner filler flaps 17 are foldably joined to the side edges 26 of the inner end walls 14. Each corner filler flap 17 comprises an inner filler corner flap 35 and an outer corner filler flap 36 joined sequentially to the side edge 26 of the inner end wall 14 and to a second side edge 37 therebetween. An inner end wall locking flap 38 is joined to the outer filler corner flap 36 at a third side edge 39.

Figure 2:
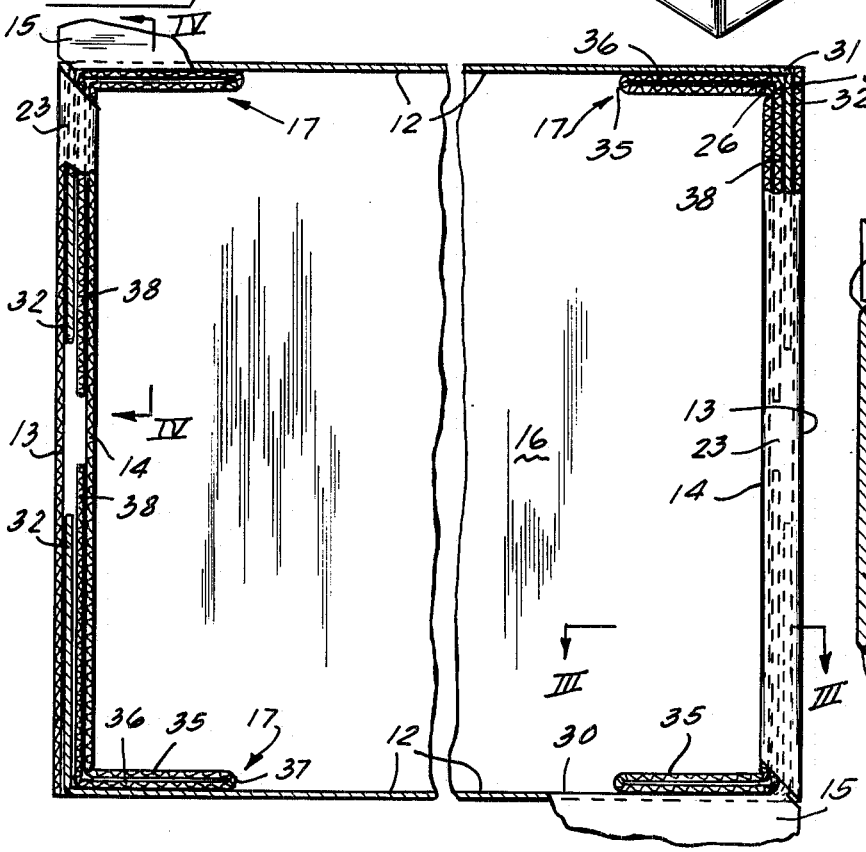
FIG. 2 is a top plan view, partly in section, of the carton of the invention.
Figure 3:
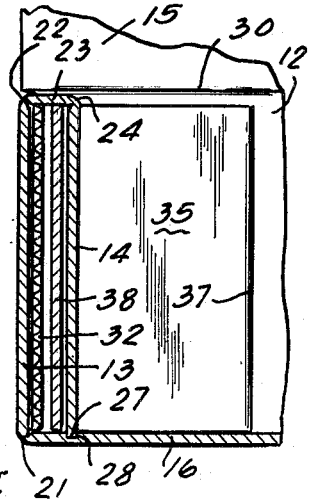
FIG. 3 is a vertical sectional view taken on line III—III of FIG. 2.
Figure 4:
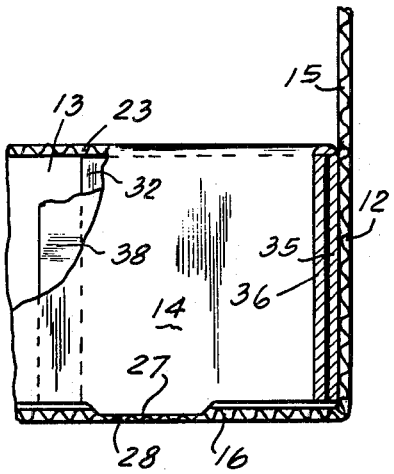
FIG. 4 is a view, partly in vertical section and partly broken away, taken on line IV—IV of FIG. 2.

The assembled orientation of the various flaps and panels of the blank of FIG. 5 is shown in FIGS. 1 through 4. Each of the corners of the carton 10 is reinforced at the end edges and end walls by the walls 13 and 14 spaced apart by the side wall end locking flaps 32 and the inner end wall locking flaps 38 therebetween. In the transverse direction, the side walls 12 are reinforced by the corner filler flaps 17 comprising the inner corner filler flap 35 and the outer corner filler flap 36. Although prior to final assembly and closure of the carton 10 with the covers 15 abutting one another there may be some space between the inner and outer corner filler flaps 35, 36, as shown in FIG. 1, such spaces are eliminated as shown in FIGS. 2 and 4 to provide a closely abutting, triple thickness of material in the fully assembled carton. Thus, the contents of the carton 10, such as a book or a plurality of books 11 has quadruple-thickness end protection (in the horizontal direction in FIG. 2) and a triple-thickness side protection in the transverse direction (vertically in the orientation of FIG. 2). The carton is further held rigidly against collapsing by the locking flaps 32 and 38 captured between the inner and outer end walls 13 and 14.

Figure 6:
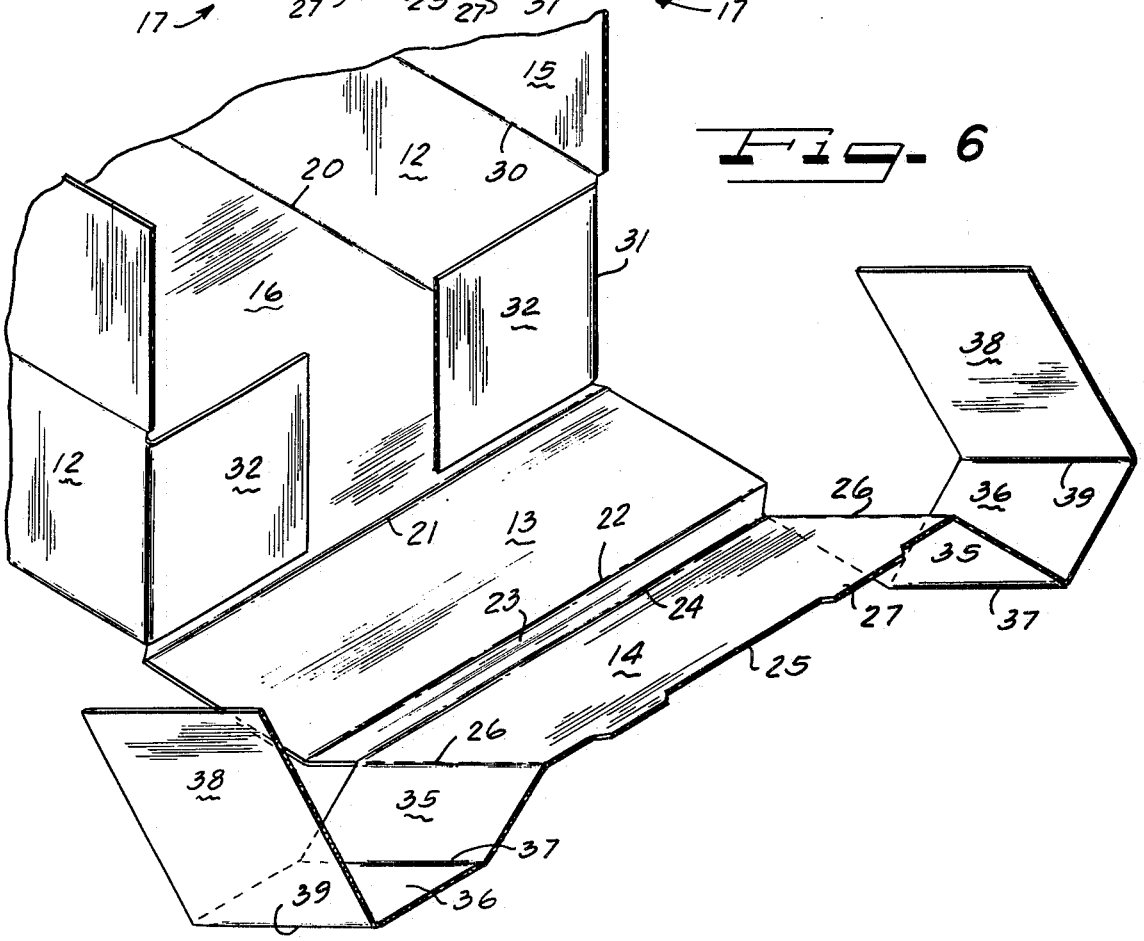
FIGS. 6–9 are perspective views showing a sequence of assembling the end walls and filler flaps of the carton.

For assembly, the side walls 12 are first erected to their upstanding positions with respect to the bottom panel 16, as shown in FIG. 6. The side wall end locking flaps 32 are brought inwardly at right angles to the side walls 12 and overlying the ends of the bottom panel 16. Then the inner end wall 14 and the connecting cover member 23 are folded along the top edge 22 of the outer end wall 13. The corner filler flaps 17 are folded about the inner end wall side edge 26. The inner filler flap 35 is further bent downwardly in the orientation of FIG. 6, while the outer filler flap 36 is bent upwardly along the second side edge fold line 37. The inner end wall locking flap 38 is also bent upwardly, about the third edge fold line 39.

Figure 7:
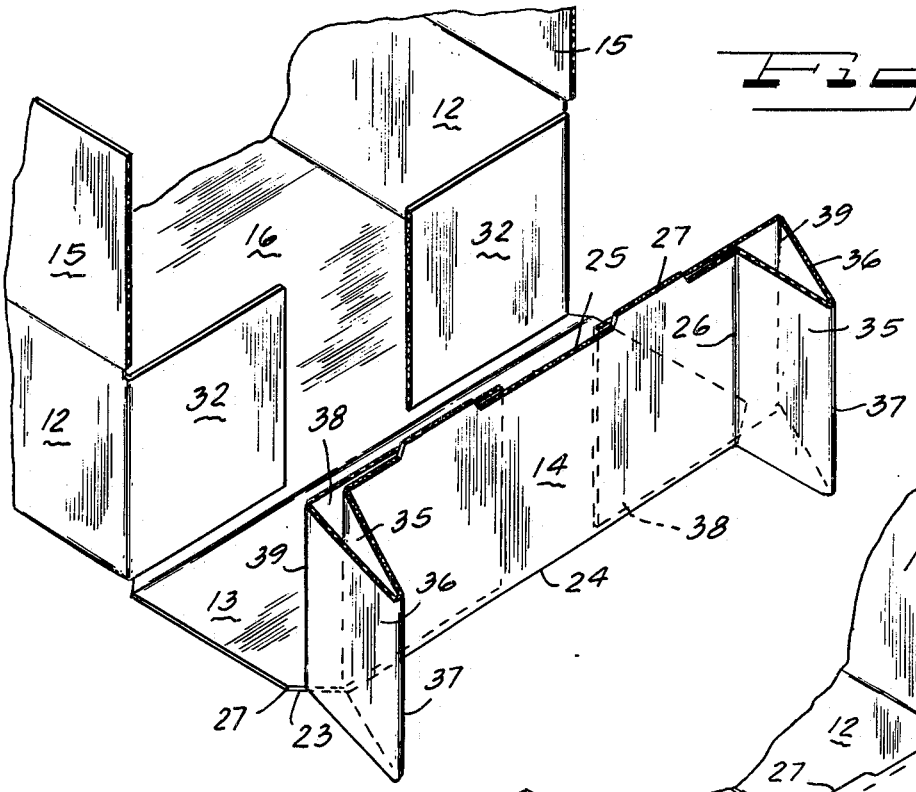

In FIG. 7, the inner end wall locking flaps 38 have been brought into facially abutting relation to the upper surface of the inner end wall 14. A sharp fold has been made along the second side edge fold 37 to bring the inner and outer corner filler flaps 35 and 36 into facially abutting relationship with one another. The third edge fold lines 39 also have been creased at right angles.

Figure 8:
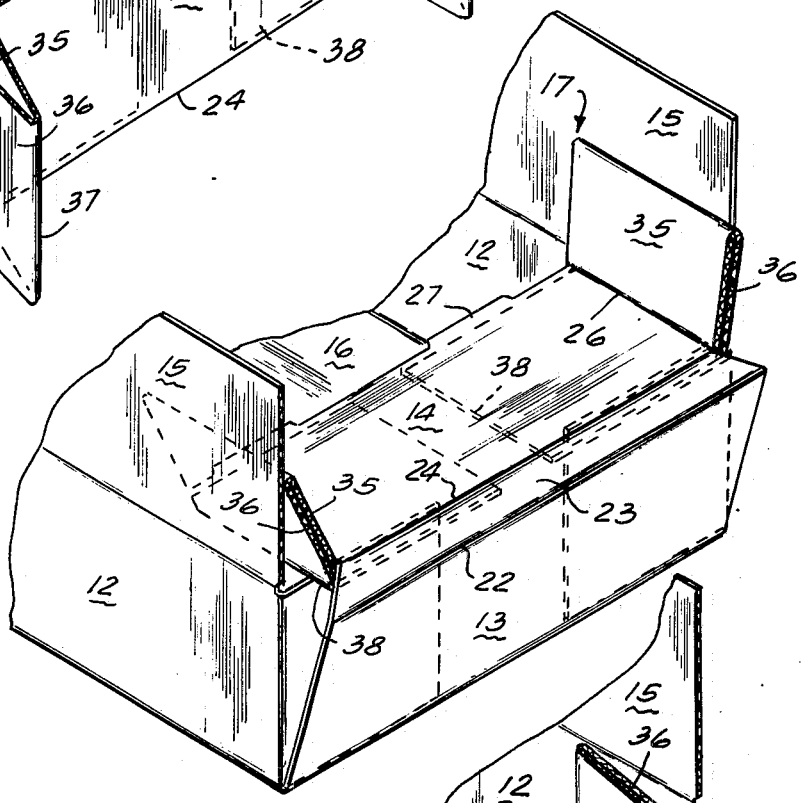
Figure 9:
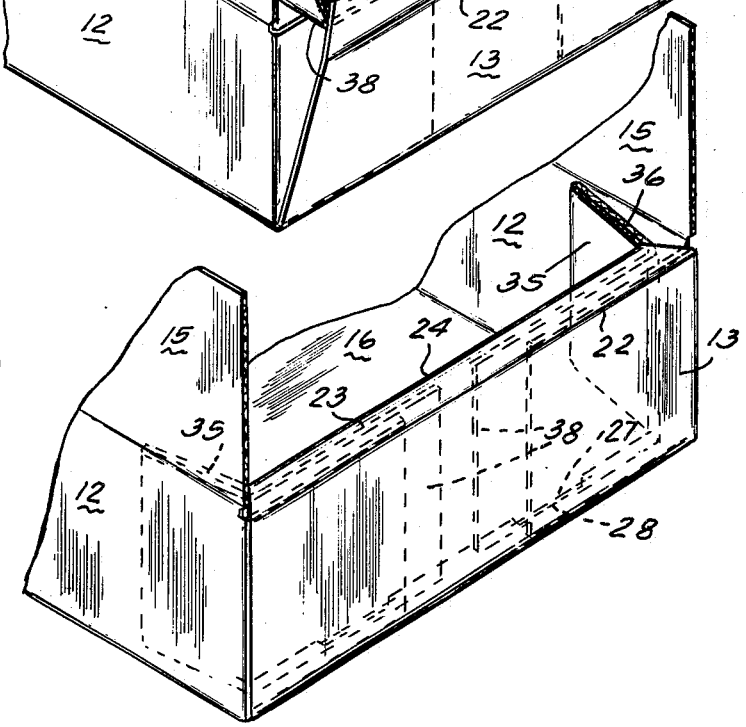

In FIGS. 8 and 9, the inner end wall assembly 14 with the corner filler flaps 17, 17 thereon is folded over the side wall end locking flaps 32 and the top edge fold lines 22 and 24 of the outer and inner end walls 13, 14 have been bent to right angles. In such final configuration, in FIG. 9, the locking tabs 27 of the inner end walls 14 have been inserted into the tab receptacles 28 in the bottom panel 16. The carton as assembled is thus ready to receive contents, as in FIG. 1, without addition of separate fillers as required in the prior art.

Although various minor modifications may be suggested by those versed in the art, it should be understood that I wish to embody within the scope of the patent warranted hereon all such modifications as reasonably and properly come within the scope of my contribution to the art.

I claim as my invention:

1. A carton die-cut and -scored from a one-piece corrugated sheet stock having a thickness, the carton comprising:

a rectangular bottom panel having a length and width defined by pairs of side and end edges;

a pair of up-standing side walls having a height and each having opposite end edges and foldably connected to each of the side edges of the bottom panel;

a pair of up-standing outer end walls each connected to one of the end edges of the bottom panel and having a top edge;

a pair of cover members having opposite sides, one of said opposite sides of each cover member being foldably connected along the entire top edge of a corresponding one of said outer end walls;

a pair of up-standing inner end walls each foldably connected at a top edge thereof to the other of said opposite sides of said cover member along its entire length, and each having a bottom edge engaging against the bottom panel opposite the top edge of said inner end wall and having opposite side edges thereby forming a rectangular plane normal to said bottom panel which is defined by said width of said bottom panel and the height of said side walls such that a dimension measured perpendicular to and between said pair of inner end walls remains constant along the entire height of said side walls;

a pair of side wall end locking flaps foldably affixed at right angles to each of the side walls at the end edges thereof and received between the inner and outer end walls;

a pair of inner corner filler flaps affixed to each of the inner end walls at the side edges thereof and extending in generally parallel spaced relation to the adjacent side walls;

an outer corner filler flap affixed to each of the inner corner flaps and folded generally parallel thereto, facially engaging between the inner flap and adjacent side wall, and having an opposite side edge; and four inner end wall locking flaps each affixed at substantially a right angle to the opposite side edge of one of the outer corner flaps and received between the adjacent side wall end locking flap and the inner end wall, whereby to provide an integral filler at each corner of the carton which is properly placed and erected and remains in place adjacent a side wall without need of extrinsic fastening means upon assembly of the carton.

* * * * *